US005764263A

United States Patent [19]

Lin

[11] Patent Number: 5,764,263

[45] Date of Patent: Jun. 9, 1998

[54] PRINTING PROCESS, APPARATUS, AND MATERIALS FOR THE REDUCTION OF PAPER CURL

[75] Inventor: John Wei-Ping Lin, Webster, N.Y.

[73] Assignee: Xerox Corporation, Stamford, Conn.

[21] Appl. No.: 596,821

[22] Filed: Feb. 5, 1996

[51] Int. Cl.[6] ..... B41J 2/01

[52] U.S. Cl. ..... 347/101; 347/98; 347/102

[58] Field of Search ..... 347/102, 101, 347/98, 105, 100

[56] References Cited

U.S. PATENT DOCUMENTS

| | | | |
|---|---|---|---|
| 2,157,388 | 5/1939 | MacArthur | 101/416.1 |
| 2,518,607 | 8/1950 | Erickson | 101/426 |
| 4,251,824 | 2/1981 | Hara et al. | 346/140 R |
| 4,327,174 | 4/1982 | von Meer | 430/530 |
| 4,381,946 | 5/1983 | Uehara et al. | 106/22 |
| 4,410,899 | 10/1983 | Haruta et al. | 346/140 R |
| 4,412,224 | 10/1983 | Sugitani | 346/1.1 |
| 4,463,359 | 7/1984 | Ayata et al. | 346/1.1 |
| 4,475,128 | 10/1984 | Koumura | 358/296 |
| 4,501,772 | 2/1985 | Luxeder | 427/208.6 |
| 4,532,530 | 7/1985 | Hawkins | 346/140 R |
| 4,569,888 | 2/1986 | Muller et al. | 428/481 |
| 4,748,453 | 5/1988 | Lin et al. | 346/1.1 |
| 5,068,140 | 11/1991 | Malhotra et al. | 428/216 |
| 5,119,116 | 6/1992 | Yu | 346/140 R |
| 5,139,574 | 8/1992 | Winnik et al. | 106/22 |
| 5,145,518 | 9/1992 | Winnik et al. | 106/21 |
| 5,207,824 | 5/1993 | Moffatt et al. | 106/22 R |
| 5,207,825 | 5/1993 | Schwarz, Jr. | 106/22 R |
| 5,214,442 | 5/1993 | Roller | 346/1.1 |
| 5,220,346 | 6/1993 | Carreira et al. | 346/1.1 |
| 5,223,026 | 6/1993 | Schwarz, Jr. | 106/20 D |
| 5,254,157 | 10/1993 | Koike et al. | 106/20 D |
| 5,281,261 | 1/1994 | Lin | 106/20 R |
| 5,356,464 | 10/1994 | Hickman et al. | 106/20 R |
| 5,371,531 | 12/1994 | Rezanka et al. | 347/43 |
| 5,389,133 | 2/1995 | Gundlach et al. | 106/22 H |

FOREIGN PATENT DOCUMENTS

| | | | |
|---|---|---|---|
| 3434875 | 10/1885 | Germany | 347/101 |
| 3434875 A1 | 10/1985 | Germany . | |
| 154882 | 7/1986 | Japan | 347/101 |
| 197637 | 7/1992 | Japan | 347/101 |
| 4194637 | 7/1992 | Japan | 347/101 |
| 255096 | 9/1994 | Japan | 347/101 |

*Primary Examiner*—Benjamin R. Fuller
*Assistant Examiner*—Christina Annick
*Attorney, Agent, or Firm*—Oliff & Berridge, PLC

[57] ABSTRACT

A paper curl reduction process is conducted by applying an aqueous dye or pigment ink in an image-wise fashion to a side of a substrate and by applying a clear aqueous liquid to the opposite side of the substrate. An ink printing device includes at least one printhead for applying an aqueous ink to one side of a substrate to form visible images and at least one applicator for applying a clear aqueous liquid to the opposite side of the substrate. A paper curl reduction process is also conducted by applying an aqueous dye or pigment ink and an optional clear aqueous liquid in a selected image-wise fashion by a thermal ink jet printing method to both sides of a substrate to achieve duplex ink jet printing with visible images on two sides of the said substrate.

16 Claims, 2 Drawing Sheets

PRINTING PROCESS, APPARATUS, AND MATERIALS FOR THE REDUCTION OF PAPER CURL

FIELD OF THE INVENTION

This invention relates to anti-curl printing methods for ink jet printers. The present invention also relates to printing process, apparatus, and materials for ink jet technologies that reduce curl in printed paper elements. In addition, it also relates to the production of ink jet images of aqueous inks on a single side or two sides of a substrate with reduced curl.

BACKGROUND

Ink jet printing is a non-impact method that produces droplets of ink that are deposited on a substrate such as paper or transparent film in response to an electronic digital signal. Thermal or bubble jet drop-on-demand ink jet printers have found broad application as output for personal computers in the office and the home.

Ink jet printing systems generally are of two types: continuous stream and drop-on-demand. In continuous stream ink jet systems, ink is emitted in a continuous stream under pressure through at least one orifice or nozzle. Multiple orifices or nozzles also may be used to increase imaging speed and throughput. The ink is ejected out of orifices and perturbed, causing it to break up into droplets at a fixed distance from the orifice. At the break-up point, the electrically charged ink droplets are passed through an applied electrode which is controlled and switched on and off in accordance with digital data signals. Charged ink droplets are passed through a controllable electric field, which adjusts the trajectory of each droplet in order to direct it to either a gutter for ink deletion and recirculation or a specific location on a recording medium to create images. The image creation is controlled by electronic signals.

In drop-on-demand systems, a droplet is ejected from an orifice directly to a position on a recording medium by pressure created by, for example, a piezoelectric device, an acoustic device, or a thermal device controlled in accordance with digital data signals. An ink droplet is not generated and ejected through the nozzles of an imaging device unless it is needed to be placed on the recording medium.

Since drop-on-demand systems require no ink recovery, charging, or deflection operations, the system is simpler than the continuous stream type. There are three types of drop-on-demand ink jet systems. One type of drop-on-demand system has an ink filled channel or passageway having a nozzle on one end and a regulated piezoelectric transducer near the other end to produce pressure pulses. The relatively large size of the transducer prevents close spacing of the nozzles necessary for high resolution printing, and physical limitations of the transducer result in low ink drop velocity. Low drop velocity may seriously diminish tolerances for drop velocity variation and directionality, thus impacting the system's ability to produce high quality copies, and also decreases printing speed. Drop-on-demand systems which use piezoelectric devices to eject the ink droplets also suffer the disadvantage of a low resolution. A second type of drop-on-demand ink jet device is known as acoustic ink printing which can be operated at high frequency and high resolution. The printing utilizes a focused acoustic beam formed with a spherical lens illuminated by a plane wave of sound created by a piezoelectric transducer. The focused acoustic beam reflected from a surface exerts a pressure on the surface of the liquid, resulting in ejection of small droplets of ink onto an imaging substrate. Aqueous inks can be used in this system.

The third type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information generate an electric current pulse in a resistive layer (resistor) within each ink passageway near the orifice or nozzle, causing the ink in the immediate vicinity of the resistor to be heated up periodically. Momentary heating of the ink leads to its evaporation almost instantaneously with the creation of a bubble. The ink at the orifice is forced out of the orifice as a propelled droplet at high speed as the bubble expands. When the hydrodynamic motion of the ink stops after discontinuous heating followed by cooling, the subsequent ink emitting process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble nucleation and formation of around 280° C. and above. Once nucleated and expanded, the bubble or water vapor thermally isolates the ink from the heater and no further heat can be applied to the ink. This bubble expands rapidly due to pressure increase upon heating until all the heat stored in the ink in excess of the normal boiling point diffuses away or is used to convert liquid to vapor, which removes heat due to heat of vaporization. The expansion of the bubble forces a droplet of ink out of the nozzle located either directly above or on the side of a heater, and once the excess heat is removed with diminishing pressure, the bubble collapses on the resistor. At this point, the resistor is no longer being heated because the current pulse has been terminated and, concurrently with the bubble collapse, the droplet is propelled at a high speed in a direction towards a recording medium or substrate. Subsequently, the ink channel refills by capillary action and is ready for the next repeating thermal ink jet process. This entire bubble formation and collapse sequence occurs in about 30 microseconds. The heater can be reheated to eject ink out of the channel after 100 to 2,000 microseconds minimum dwell time and to enable the channel to be refilled with ink without causing any dynamic refilling problem. Thermal ink jet processes are well known and are described in, for example, U.S. Pat. No. 4,601,777, U.S. Pat. No. 4,251,824, U.S. Pat. No. 4,410,899, U.S. Pat. No. 4,412,224, U.S. Pat. No. 4,463,359, U.S. Pat. No. 4,532,530, U.S. Pat. No. 5,281,261, U.S. Pat. No. 5,139,574, U.S. Pat. No. 5,145,518, the disclosures of each of which are totally incorporated herein by reference.

Ink jet printing is a non-impact method that produces droplets of ink that are deposited on a substrate such as plain paper or coated paper or textile cloth or transparent film in response to an electronic digital signal. Thermal or bubble jet ink jet printers which are operated in a drop-on-demand mode have found broad applications in digital printers, plotters, and fax machines as output for personal computers and large computers in the office and the home.

In a single-color ink jet printing apparatus, the printhead typically comprises a linear array of ejectors, and the printhead is moved relative to the surface of the print sheet (substrate or recording medium), either by moving the print sheet relative to a stationary printhead, or vice-versa, or both. In some types of apparatus, a relatively small printhead or an array of two or more printheads in a partial width printer moves across a print sheet (substrate) numerous times in swathes, much like a typewriter. Alternatively, a printhead, which consists of an array of ejectors and extends the full width of the print sheet, may pass ink down the print sheet (substrate) one line at a time before the print sheet is advanced to complete the production of full-page images in what is known as a "full-width array" (FWA) printer. When the printhead and the print sheet are moved relative to each other, image-wise digital data is used to selectively activate the thermal energy generators (resistors) in the printhead over time so that the desired image will be created on the print sheet.

In the thermal ink jet printing water is usually a key component, which is responsible for the bubble formation and propelling the ink out of nozzles toward the imaging substrate (print sheet). The use of water in large concentrations, however, has also some disadvantages. Water has a fast evaporation rate relative to high boiling organic solvents (e.g. humectants, anti-curl agents, etc.). Ink ingredients such as water soluble or water compatible dyes, pigments, biocides, and other chemical additives may become destabilized due to the loss of water during idling time. As a result printheads may become plugged, which produce some jetting failure. Water also interacts with paper to cause two major distortions known as paper cockle and paper curl. Paper cockle is a distortion in which bumps, indentations and other irregularities are randomly produced on the printed paper, giving the paper a "wrinkled" appearance. Curl is a phenomena in which the edges or corners of the paper migrate towards (toward imaging side) or away from (away from the imaging side) the center of the paper. Curl is possibly caused by the printed aqueous ink on one side of the paper releasing stress on the surface of the paper which induces a differential paper stress or uneven stress between top and bottom surfaces for the paper after drying and aging. The direction of curl may be toward the printed (imaged) side of the paper, or it may be toward the non-printed (non-imaged) side. For the purpose of this invention, paper "curl" is defined as including both curling and cockling of the paper substrate.

Curl may appear immediately after printing or may take a day or two to manifest. In its final state, the paper sheet in a severe case may take the form of a tube, a roll, or a scroll. Curled paper cannot be stacked sheet upon sheet, thereby causing much inconvenience to the user. Curled sheets are difficult to display or store and cannot be used in processes requiring near planarity, such as media feeding, tracking, and print alignment. Curl is most prevalent in solid area printing and is therefore a more acute problem in graphics than in text printing. For the same reason, it is also a concern in four color printing especially when it involves printing composite colors or where graphics are prominent. Curl is also a problem when a large quantity of ink is needed to achieve high optical density images.

The severity of the paper curl may be affected by the property of the plain and coated paper substrates, the type of aqueous ink used in the printing, temperature of the substrate during printing, and the ink jet printing process. Papers that have a small built-in differential stress between the top and bottom surfaces in the paper manufacturing process may provide little curl after ink jet printing. On the other hand papers with a large built-in differential stress between the top and bottom surface will tend to exhibit significant paper curl after ink jet printing. The degree of differential stress that is built into the papers depends on the conditions of the paper manufacturing process. Papers that are thicker or heavier and have a stronger mechanical strength tend to give lower degree of paper curl as compared to those thinner papers with weaker mechanical strength. Once a paper used in the ink jet printing is selected then the fate of curl formation is somewhat fixed. Some papers will develop curl much easier than others. In an ordinary office environment, plain and coated papers are used in the ink jet printing. Depending on the paper supply situation in the office, a customer may not have a chance to select a proper paper with a smaller curl property for the ink jet printing. There is a need to have a process that reduces paper curl with minimum impact from the paper.

Inks having a large amount of anticurl agent may reduce the curl. However, the use of the required amount of the anticurl agents in the inks may increase the viscosity of the ink and causes great difficulty in jetting the inks, especially after some idling in a printhead. This is especially true when water evaporates near the nozzles during idling time, resulting in a dramatic increase in ink viscosity and possible jetting failure. Water evaporation during idling time can also cause crystallization and precipitation of dyes or agglomeration of pigments. Most of the anticurl agents have high boiling point and high viscosity. Thus, the use of high viscosity anticurl agents in required large quantities may cause short ink latency and increase jetting difficulty. This is especially true when a high resolution ink jet printhead is used, which has a narrow nozzle opening (about 10 to 49 microns for a 400 and 600 spots per inch resolution printhead as compared to greater than 49 microns in a 300 spots per inch resolution printhead). Due to these aforementioned limitations there is a need to develop a process for the ink jet printing whereby ink jet printing of solid area images for graphic applications can be easily carried out to give reduced paper curl.

In ink jet printing, it is desirable to reduce the consumption of paper for economic and environmental reasons. Duplex printing sometimes may be desired. However, if a paper has been printed with aqueous ink jet images having solid areas the paper may form curl or cockle, which prohibits smooth paper feeding in subsequent ink jet printing. Thus, printing duplex (on two sides of a paper) can be difficult if the imaged paper is not treated quickly after printing. Paper curl progressively becomes worse upon aging after printing. There is a need to provide a means for both single sided ink jet printing and two sided (duplex) ink jet printing to provide images on papers with reduced curl.

Ink jet printing (checkboarding or single pass) may also affect paper curl in multiple color printing especially printing that involves a solid area image. There is also a need to provide a decurling process to reduce paper curl.

Depending on the type of color images printed, paper curl caused by aqueous ink jet inks may vary. For example, printing blue, green and red images on a paper requires the use of several inks (e.g., 200% of normal ink coverage) which is significantly more than when printing single color cyan, magenta and yellow images (e.g. 100% of normal ink coverage). As a consequence, the printing of solid area images of blue, green and red (composite colors) create a greater paper curl problem than those of single color images (e.g., cyan, magenta and yellow). Increased curling also can be found when solid areas of images are printed in a single pass mode rather than multiple passes (e.g., checkerboarding) mode.

In an effort to reduce cockle and curl in ink jet printers, efforts have been made to provide anti-curl and anti-cockling agents to reduce this problem. For example, U.S. Pat. No. 5,356,464 to Hickman et al. describes anti-curl agents at a desired amount that may be utilized in ink jet inks. However, such anti-curl agents negatively affect the stability of inks by increasing the viscosity. Such inks decrease latency and increase clogging of ink jet printhead nozzles.

U.S. Pat. No. 5,207,824 to Moffatt et al. describes an ink jet ink comprising an anti-cockling agent for thermal ink jet printers. In some cases, the use of a required amount of anticockling agents in the inks to reduce curl tends to aggravate the nozzle pluggage and jetting failure. This is possibly due to their contribution of the viscosity increase of inks and incompatibility of ink ingredients with some dyes or pigments. The effective use of anticockling agents in ink sometimes may be limited.

There is thus a need in the art for new methods of reducing curl in printed paper for ink jet printers. There is also a need for ink jet printers that utilize aqueous inks and clear aqueous liquids that can reduce paper curl.

There is also a need in the art for a printing process that allows printing in full page graphics/text without producing paper curl with inks having high pigment concentrations. There is also a need for a process, an apparatus and ink jet inks that provide enhanced print quality in high resolution printers without causing undesired curl of the printed materials.

SUMMARY OF THE INVENTION

The present invention relates to a process for reducing paper curl in ink jet printing comprising applying in image-wise fashion to a substrate an aqueous ink composition having a pigment and/or dye and applying to the non-imaging side of the paper a clear aqueous liquid.

In addition, this invention also allows the possibility of using a wide variety of paper substrates with different type and size for ink jet printing with reduced curl. This invention provides ink jet printing of text and graphic applications including solid area images on a substrate with reduced curl.

Additionally, this invention also provide a means for single sided ink jet printing and two sided (duplex) ink jet printing to provide visible images on one or two sides of a substrate, respectively with reduced curl. A decurling process to reduce paper curl in ink jet printing using either a checkerboarding mode or a single pass mode in the presence or absence of heat is also provided. The means for providing optional heat in the decurling printing process are also described.

Furthermore, possible compositions for the aqueous inks and the clear aqueous liquids used in the anti-curl printing process of this invention are also provided. The anti-curl printing process of this invention allows the use of anti-curl agents and other ink ingredients in an small amount which do not cause undesired jetting (e.g. short latency, etc.) and clogging problems that are usually associated with other printing process. The present invention is also related to an ink jet printing device (or apparatus) that reduces paper curl.

DETAILED DESCRIPTION OF EMBODIMENTS

Figure 1:
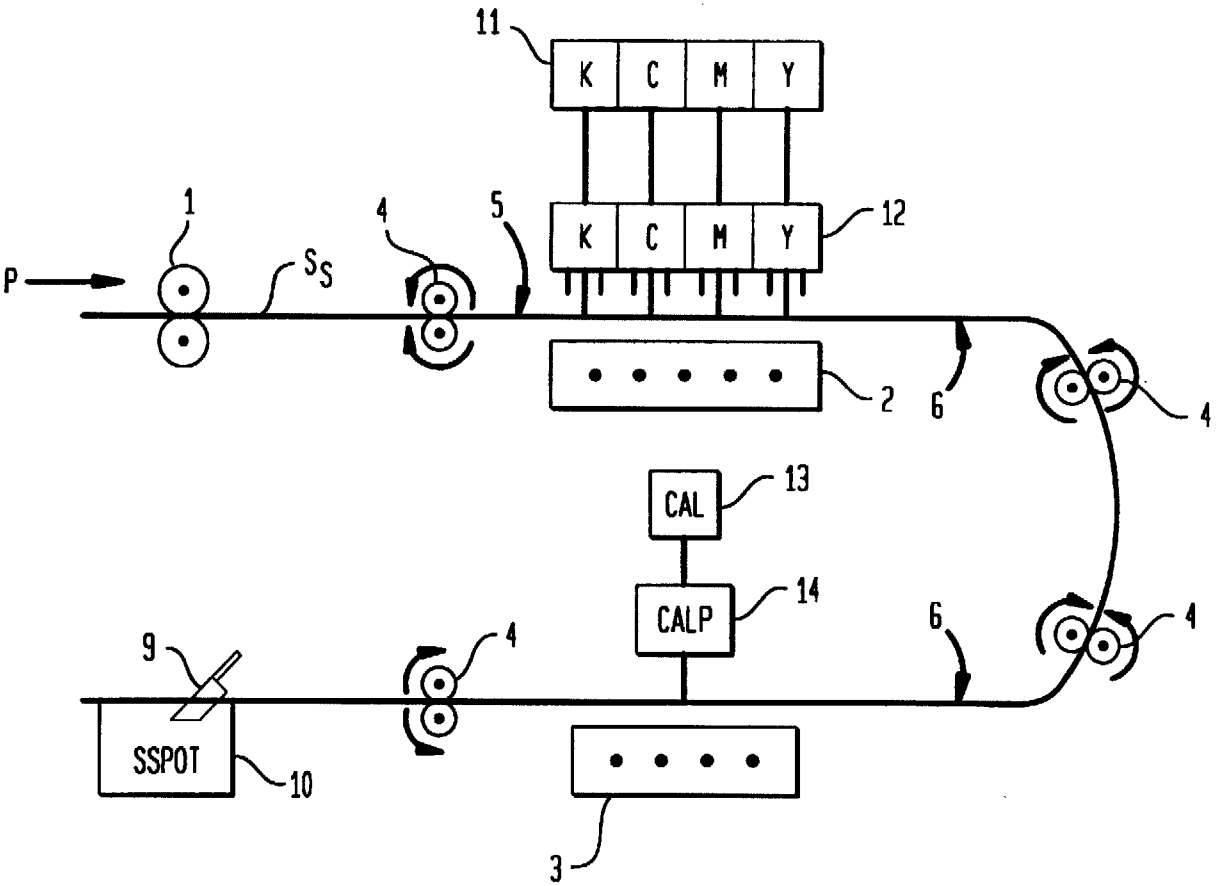
FIG. 1 illustrates schematically a printing system according to one embodiment suitable for the process of the present invention. Details of FIG. 1 will be described shortly in the section of detailed description of embodiments.

The paper curl reduction process according to the invention may be achieved by applying a clear aqueous liquid on the non-imaging side of a substrate with the aqueous ink or inks being applied on the opposite side of the paper. The clear aqueous liquid and the aqueous ink or inks may be applied with or without heat. It is believed that the stress release caused by printing the clear aqueous liquid on one side of a substrate (e.g., paper) is balanced by applying the aqueous ink or inks on the other side of the substrate, thus reducing long-term paper curl (cool curl). The application of the clear aqueous liquid does not contribute to or affect the color of the non-imaging side (the side receiving the clear aqueous liquid) of the substrate and does not affect the appearance of the imaging side (the side receiving the aqueous ink or inks) of the substrate. This paper curl reduction process is useful for producing ink jet images on a single side (the side received the aqueous ink or inks) of a paper substrate.

The aforementioned paper curl reduction process may also be repeated again to provide visible images on both sides of a substrate in a two sided (duplex) ink jet printing process. In this case, the imaged paper substrate from the single sided paper curl reduction printing process of this invention is subjected to a second aqueous ink(s) printing process on the nonimaging side (the side which did not previously receive the aqueous inks or inks). In this process, application of the clear aqueous liquid is optional and does not affect the previously formed images.

In another embodiment of this invention, a process for the reduction of curl in two sided (or duplex) ink jet printing comprises:

(a) application of at least an aqueous ink comprising a dye or a pigment and an optional clear aqueous liquid in an image-wise fashion to one side of a substrate, (b) application of at least an aqueous ink comprising a dye or a pigment and an optional clear aqueous liquid in an image-wise fashion to the opposite side of the said substrate, and (c) providing optional heat to the substrate by a heating means at any stage before, during, and after the applications of the aqueous ink and the clear aqueous liquid. The two sided (duplex) ink jet printing of this invention produces visible images on both side of a substrate with reduced curl. The aqueous ink or inks and the clear aqueous liquid employed in step (a) can have the same or different compositions from those in the step (b). The use of the clear aqueous liquid is optional in the two sided (or duplex) ink jet printing to reduce curl.

The clear aqueous liquid of this invention can be applied to the substrate by utilizing an imaging device such as a continuous ink jet device, a thermal ink jet printhead, a piezoelectric device, an acoustic ink jet device, and other similar jet ink devices. Additionally, other means of providing water or moisture to the side of the paper may be employed such as a wet roll or brush, a steaming device, a spraying device, or the like. Preferably, a thermal ink printhead is utilized for this purpose.

In the single sided ink jet printing, the printing pattern of the clear aqueous liquid on the non-imaging side of the substrate may be the same as or similar to the patterns or images that are printed by the aqueous ink or inks on the opposite side of the substrate. Preferably, the printed pattern on the imaging side of the substrate is identical to the pattern of the clear aqueous liquid applied to the non-imaging side of the substrate. However, the print pattern of the clear aqueous liquid may be the same or different from that of the aqueous ink or inks. In this embodiment, the difference in stress between the two sides of the substrate is greatly minimized. This is especially important for printing a solid area image or when using applications of multiple inks on the substrate. The amount of clear aqueous liquid applied to the non-imaging side of the substrate may be adjusted depending on the need to reduce paper curl. For example, partial toning patterns including half tone, third tone, quarter tone, random pixels, etc., or complete solid area coverage of the clear aqueous liquid may be employed.

The application of the clear aqueous fluid to the non-imaging side of the substrate may be conducted at any stage of the ink printing process. For example, the clear aqueous fluid may be applied either before, during, or after the printing of the ink or inks on the imaging side of the substrate. Preferably, the clear aqueous liquid is applied to the non-imaging side of the substrate after the desired color or black image is created on the imaging side of the paper. This minimizes the need for any unnecessary equipment and paper handling operations. As in the ink jet printing processes that may be utilized, the clear aqueous fluid may be applied using single pass and/or checkerboarding techniques. The technique utilized for application of the ink on the imaging side of the substrate may be the same or different from the application technique utilized for the clear aqueous fluid on the non-imaging side of the substrate. In some embodiments, a checkerboarding technique combined with a heat and delay technique is employed.

Heat can be applied to the substrate either before, during or after application of the clear aqueous liquid on the substrate. Moreover, heat may be applied to the substrate at any time before, during or after the printing or application of the aqueous ink and the aqueous liquid. The heat may be applied using any suitable heating means including a heated belt, a heated platen, a heated roll, a lamp, a radiant heater, a microwave heater, etc. either with or without the assistance of vacuum and/or hot circulated air. Preferably but not limited, the heating for drying the ink on the image side of the substrate is accomplished by the same mechanism utilized to dry the clear aqueous liquid on the non-imaging side of the substrate. Visible images on a single side of the substrate can be obtained with reduced curl.

The aqueous ink or inks employed in the two sided (duplex) ink jet printing of this invention are preferred to have the same or similar compositions for printing both sides of the substrate. Paper curl reduction may be achieved by the duplex ink jet printing (visible images on both sides of the substrate) either with or without the application of the clear aqueous liquid.

If similar images or images with low ink coverage (e.g. text) are printed on both sides of a substrate, then there may not be a need to apply the clear aqueous liquid on the substrate. This is due to the approximately equal levels of stress release on the substrate obtained by printing similar images in similar areas on each side of the paper. However, if the images are drastically different in size, location and toning (ink density) then the clear aqueous liquid may be applied selectively to any selected side of the substrate to achieve balanced paper stress and curl reduction. The clear aqueous liquid may be applied in certain selected areas on one side of the substrate, especially just opposite to a color or black solid area as long as the clear aqueous liquid does not cause distortion of the visible images. Applying partial tone or solid area of the clear aqueous liquid on the paper may be employed if desired. The clear aqueous liquid may be applied next to or over previously applied ink images provided the clear aqueous liquid does not affect or distort the desired ink images.

Certain clear aqueous liquids are preferred for practicing the present invention in conjunction with aqueous ink jet inks. In particular, they are of low cost; they are compatible with many known humectants and ink jet ink ingredients; they may have high boiling points and low vapor pressures; they are suitable for imaging processes employing heat and delay techniques without generating a high concentration of vapor or odor; they are relatively non-toxic; they also do not easily plug or clog ink jet nozzles; they are inhibitive to bacteria growth; and they are easier to formulate than the aqueous ink or inks because lack of a solid colorant.

The clear liquid of this invention may, for example, comprise water, solvent, optional humectant, surfactant, dispersing agent, bubble nucleation agent, pH buffering agent, anti-curl or anti-cockle agent, penetrant, biocide, chelating agent, anti-oxidation agent, water soluble polymer, and other desired chemicals. Commonly used humectants include ethyleneglycol, diethylenenglycol, triethyleneglycol, tetraethyleneglycol, propyleneglycol, dipropyleneglycol, tripropyleneglycol, tetrapropyleneglycol, dimethylsulfoxide, sulfolane, betaine, urea, glycerine, glycerine propoxylates, glycerine ethoxylates, glycerine mixed ethoxylates and propoxylates, trimethylopropane ethoxylates, trimethylopropane propoxylates, trimethylopropane mixed ethoxylates and propoxylates, pentanediols including 1,5-pentanediol, hexanediols including 1,6-hexanediol, trimethylolpropane, hexanetriols including 1,2,6-hexanetriol, polyethyleneglycol, polypropyleneglycol, glycolether derivatives including butylcarbitol, butylcellosove, and the like, alcohols including alkyl alcohols, amino alcohols including ethanolamine, diethanolamine, and triethanolamine, ketones, amides including N-methylpyrrolidinone, N-cyclohexylpyrrolidinone, and the like, and thio (sulfur) derivatives of the aforementioned derivatives. If it is necessary to have a fast penetrating clear aqueous liquid for decurling purposes, the surface tension of the liquid can be controlled below 55 dyne/cm with the use of a surfactant or an organic solvent. The surfactant or dispersing agent can be an ionic (anionic, cationic, and amphoteric) or nonionic material. The clear aqueous liquid of this invention may have a composition similar to or the same as the aqueous ink(s) used for the imaging only without any colorant. It is preferred that the ink ingredients in the clear aqueous liquid does not contain any nonvolatile color material or contaminant. This is because the use of this clear aqueous liquid will not create any visible image on the back of a paper in this invention (for single sided and two sided ink jet printings). A simple composition of the clear aqueous liquid may comprise just water and a very small amount of surfactant.

Aqueous ink or inks of this invention, for single sided ink jet printing and two sided (duplex) ink jet printing can comprise water, colorants (dye(s) or pigment(s)), humectants, ink penetrants, bubble nucleation aids, anticurl agents, biocides, pH buffering agents, soluble polymers, antioxidants, anticlogging agents, antikogation agents, anticockle materials, surfactants, and dispersing agents. Ink jet inks selected for single sided and duplex printing are preferred to have all the desired attributes for high image quality, including excellent optical density and color gamut, adequate latency, and both short-term and long-term jetting performance.

If visible images are needed on both sides of the paper then ink jet printing of the aqueous ink or inks may be carried out on the side of paper that previously did not receive the aqueous ink or inks. This is because the treatment of clear aqueous liquid of this invention does not produce visible images on the paper, thus, allowing any desired visible images to be printed again on the same side of the paper. This process produces visible ink jet images on both sides of a paper, which is one of the effective methods for duplex printing with low curl. Alternatively, the paper having an aqueous ink jet image can also be printed quickly on the nonimaged side with selected ink jet aqueous ink or inks comprising at least a dye or a pigment to give visible images on both sides of the paper with low curl. The duplex printing may also be carried out quickly in a sequential manner before any significant paper curl sets in, which would hinder subsequent duplex ink jet printing. Ink jet printing on both sides of a paper substrate minimizes the differential stress between the top and bottom surfaces and provides reduced curl. The same or different aqueous ink jet inks can be used in duplex ink jet printing. The aqueous ink jet inks used in the duplex printing may be selected from dye or pigmented based inks. In duplex ink jet printing, the use of the clear aqueous liquid may not be necessary and it is optional depending upon the circumstances and requirements. The process for producing images on two side of a substrate with low curl can be a batch or a continuous printing process.

The substrate employed can be any cut sheet or continuous web substrate compatible with aqueous-based inks, including plain paper, such as Xerox® series 10 paper, Xerox® 4024 paper, bond papers, commercial papers or the like, coated papers (or special ink jet papers), such as those available from Xerox Corporation, Hewlett Packard Co., Canon Co., and Oji Paper Co., and ink jet transparency materials suitable for aqueous inks or ink jet printing processes including those from Xerox Corporation, Artright Co. and Hewlett Packard Co., or the like.

Any suitable ink jet printing apparatus may be employed for the anti-curl printing process (process for the reduction of curl) of the present invention. Such an apparatus, however, should be equipped with not only a printhead, software, computer, necessary hardware and electrical connections in an ink jet printer for printing ink, but also must include an applicator for possible applying to a substrate the clear aqueous liquid of the present invention. Furthermore, the ink jet printing device (or apparatus) including printheads, printing assembly comprising several printheads (e.g., for printing black, cyan, magenta, yellow colorants) and full-width array printheads should be capable of applying the aqueous ink or inks to one or both sides of the substrate as well as capable of applying the clear aqueous liquid of the present invention to one or both sides of the substrate.

Figure 2:
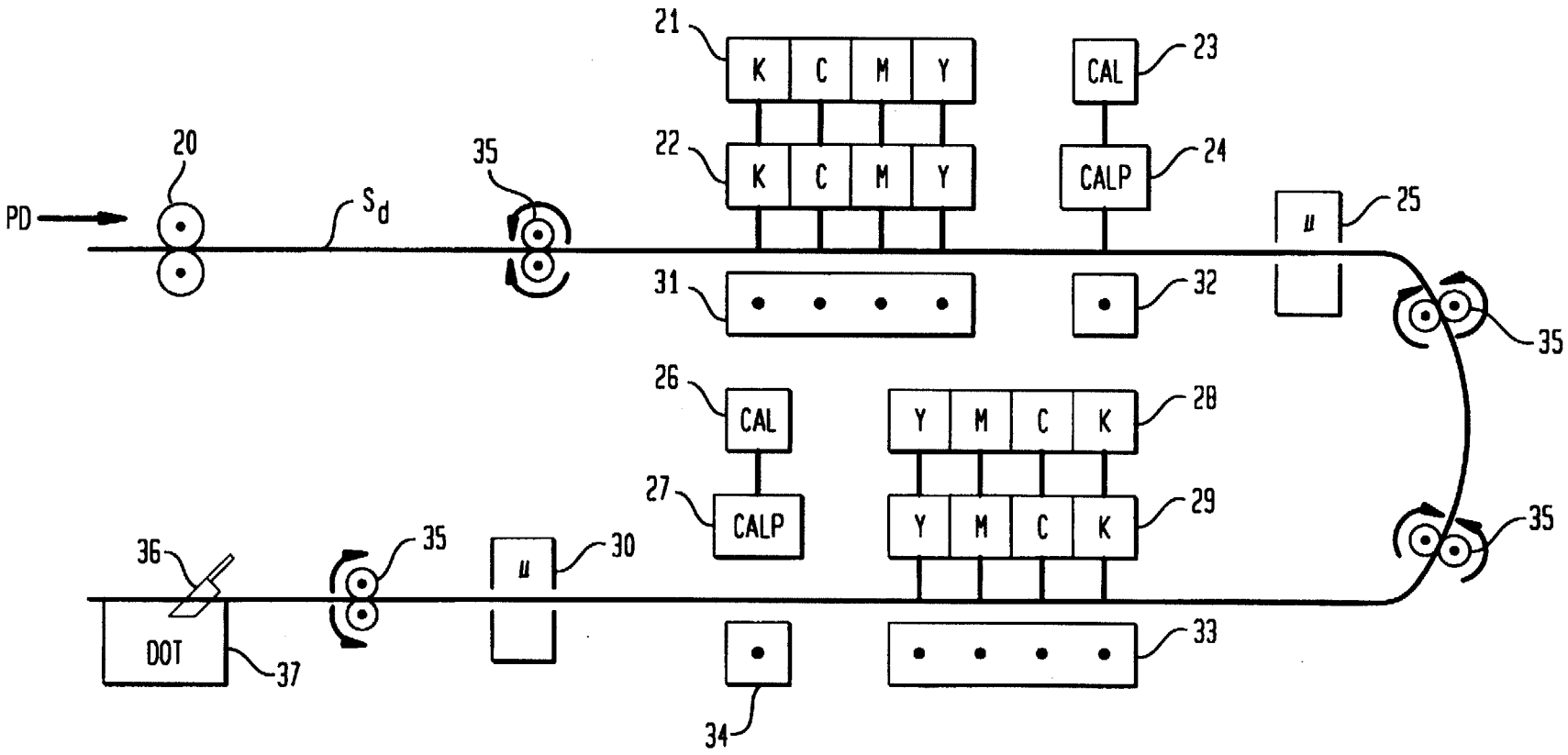
FIG. 2 illustrates schematically a printing system according to another embodiment suitable for the process of the present invention. Details of FIG. 2 will be described shortly in the section of detailed description of embodiments.

FIGS. 1 and 2 exemplify the basic elements of ink jet printing systems for single side and two sides (duplex) printing respectively according to the present invention.

FIG. 1 represents an example of a thermal ink jet printing system of the present invention in which ink is printed on one side of a substrate 5 and the clear liquid of the present invention is applied on the other side of the substrate 6. In particular, the sheet $S_s$ (substrate for single side ink jet printing) is caused to move in a printing process direction P by using different substrate advancing devices including a belt, rollers, guiding wheels, a rotating drum, a reciprocating platen etc. Even though rollers 4 (or paper advancing devices with arrows indicating rotating direction) are indicated as being the means for moving the sheet $S_s$, other means may be used such as a belt, guiding wheels, a rotating drum or a reciprocating platen. Additionally, even though the substrate $S_s$ is illustrated as being a continuous sheet, the substrate $S_s$ may be discontinuous. For a continuous substrate sheet, it can be cut with an optional cutter 9 to give a desired substrate length for the delivery of an imaging substrate to a single side printing output tray (SSPOT) 10. A printhead assembly 12 comprising black (K), cyan (C), magenta (M), and yellow (Y) printheads and their corresponding ink cartridges is located at one point along the process direction of the sheet $S_s$. For high volume ink jet printing the printhead assembly may be fed with an optional ink supply system 11, which comprises black, cyan, magenta, and yellow ink reservoirs with separate lines connecting them to their corresponding printheads (black, cyan, magenta, and yellow printheads). Various printheads may be utilized including one or more of desired ink jet printheads selected from continuous ink jet, piezoelectric, thermal ink jet, and acoustic ink jet printheads, as well as full-width array ink jet printheads (e.g., full-width thermal ink jet printheads). In an alternative embodiment, multiple printheads may be utilized that would be capable of applying various color inks of one's choice. The printhead printing sequences for the application of color inks can be flexible (e.g., Y, C, M, K; Y, M, C, K; K, M, C, Y; K, C, M, Y; etc.) and is not limited only to K, C, M, Y configuration as shown in FIG. 1. Single-pass as well as multiple-pass (e.g., moving the printheads across the substrate several times to complete the images) or checkerboarding ink jet printing processes may be utilized to create color and/or black images on the substrate. The ink jet printing can be carried out optionally either with or without heat which is provided by heating means 2 and 3 such as radiant heaters are shown in FIG. 1 for drying inks. Another printhead 14 is located downstream of the process direction for printing a clear aqueous liquid onto substrate side 6 which is opposite to imaging side 5 (comprising visible image) of substrate $S_s$. Even though the printhead 14 is illustrated as being located downstream from the ink jet printhead assembly 12, the printhead 14 may be located before or after the printhead assembly 12. If desired, the locations of 12 (visible ink printhead assembly) and 11 (visible ink reservoirs with connecting lines) can be transposed with 14 (clear aqueous liquid printhead, CALP) and 13 (cartridge or reservoir and connecting line for the clear aqueous liquid, CAL). The clear aqueous liquid of the present invention is fed to the printhead 14 via supply 13. The printhead type may be identical to or different from that of the printhead assembly 12 (e.g., piezoelectric ink jet, thermal ink jet, acoustic ink jet, continuous ink jet, etc.) and may include any of the above-mentioned printheads. Other means of providing the clear aqueous liquid to the substrate $S_s$ include a wet-rolling device, a steaming device, a spraying device, and the like.

In addition to the printheads 12 and 14, there is also disposed along the path of the sheet $S_s$ ink drying means 2 and 3 as well as an optional substrate preheating device 1 including heated rollers or drums, heated belts, heated elements, lamp, a radiant heater, etc. The ink drying means 2 and 3 may be provided by applying heat to the substrate $S_s$ using any known heating means including a heating belt, platen, or roll; a lamp; a radiant heater; a microwave heater; and the like, either with or without the assistance of vacuum and/or hot circulated air. Heat may be provided to the substrate before, during or after application of ink and/or the clear aqueous liquid. For illustration purposes, radiant heaters of the ink drying means 2 and 3 are placed below the substrate $S_s$ and printheads 12 and 14 for providing heat to the substrate before, during, and after printing. Preheating device 1 and ink drying means 12 and 14 can be at any location in the ink jet printing process.

Printhead 14, which applies the clear aqueous liquid, may be located on the same side or different side of the substrate as printhead assembly 12 and may be located before or after printhead assembly 12. The substrate $S_s$, after application of inks from printhead assembly 12 or after application of the clear aqueous liquid from printhead 14, may be transposed for application of clear aqueous liquid or inks to the opposite side of the substrate $S_s$.

FIG. 2 illustrates an alternative embodiment of the ink jet printing apparatus (device) according to the present invention. The substrate is moving in a process printing direction PD. In this embodiment, ink may be applied to both sides of the substrate $S_d$ (substrate for duplex ink jet printing). Ink jet printhead assemblies 22 and 29, which include any of the printheads mentioned herein and previously (e.g., can be similar or the same as printhead assembly 12 in FIG. 1), apply aqueous inks via ink supplies 21 and 28 (can be in the form of ink reservoirs or cartridges) of the same or different types of ink (e.g., black(K), cyan(C), magenta(M), and yellow(Y) with the same or different compositions) to the substrate $S_d$. Multiple printheads may be utilized for the application of various colors. Printheads 24 and 27 (clear aqueous liquid printheads, CALP), which include any of the printheads disclosed herein, are fed with clear aqueous liquid(s) from supplies 23 and 26 (CAL) and may have the same or different clear aqueous liquid composition). The clear aqueous liquid supplied in one printhead may be the same as or different from the clear liquid supplied in the other (e.g., different humectants, different viscosities, different surface tensions, or containing different additives). Alternatively, the clear aqueous liquid may be applied to the substrate $S_d$ by other means as mentioned herein or previously. Heat may be applied to the substrate $S_d$ at any location, including before, during and after application of ink and/or clear aqueous liquid. Illustrated are radiant heaters 31, 32, 33, and 34, and optional microwave heaters 25 and 30. Again, any other conventional heating means including heated rollers, heated drums, heated belts, heated platens, lamps, laser diodes, and etc. may be utilized as described herein. Substrate advancing device 35 including rotating rollers, rotating wheels, transporting device for belt or platen, and guiding gears may be used.

Even though the printheads of assemblies 22 and 29 for applying the aqueous inks are located on (or facing) the opposite side (all above the substrate in FIG. 2) of the printheads for applying clear liquid, the location of the printheads for applying the aqueous inks and the clear aqueous liquids may be flexible with one being next to or on the same side as the other. The printhead arrangement and printing sequences for the application of color inks can be flexible (e.g., Y, C, M, K; Y, M, C, K; K, M, C, Y; K, C, M, Y; etc.) and is not limited to K, C, M, Y as shown in FIG. 2. The use of printheads 24 and 27(CALP) with their corresponding clear aqueous liquids (CAL) in duplex printing can be optional and selective in printing patterns as long as the objectives of reduction of paper curl is achieved for this invention.

In a simple case, the application of the clear aqueous liquid may not be needed since printing on both sides of a substrate ($S_d$) with the same or similar aqueous inks can counterbalance the stress release due to the application of the aqueous inks. In this case, duplex ink jet printing can be achieved with visible images on two side of the substrate (paper) without using the clear aqueous liquids. However, if necessary, the application of clear aqueous liquids can be carried out for curl reduction without distorting the desired visible images. Desired printing patterns (partial tone or full tone, or random pixels, etc.) for the clear aqueous liquids to reduce curl can be predetermined and selectively executed by software and computer without interferring with printing of the visible images. Additionally, for duplex printing (printing on both sides of the substrate $S_d$), the substrate $S_d$ may be utilized in a printing system according to FIG. 2 or in a printing system according to FIG. 1 in which the substrate $S_s$ ($S_s$ in FIG. 1) is fed past the printheads 12 and 14 two or more times (the first time printing visible images on the top side of the substrate and second time printing visible images on the bottom side of the substrate before collecting the final substrate with images on both sides in the output tray).

In an alternative embodiment, all of the printhead assemblies 22 and 29 and printheads 24 and 27, in FIG. 2 may be independently selected to be located either on one side or the opposite side of the substrate $S_d$ with the substrate being transposed between application of ink and/or clear aqueous liquid from printhead assembly 22 and printhead 24 as well as printhead assembly 29—and printhead 27 for application of ink and/or clear aqueous liquid to the desired side of the substrate $S_d$. For duplex printing, printhead assembly (comprising K, C, M, Y printheads) 22 may be located on one side of the substrate for printing inks and the printhead assembly (comprising K, C, M, Y printheads) 29 can be located on the opposite side of the substrate.

In FIG. 2 the substrate $S_d$ is shown in a horizontal position and the printhead assemblies 22 and 29 and printheads 24 and 27 deliver inks and the clear aqueous liquids downward onto the substrate. The substrate that receives the inks to give visible images can be arranged in any desired position (e.g. vertical or inclined, or horizontal position) and it is not only restricted to a horizontal position. If the substrate is not in a horizontal position for receiving the inks and the clear aqueous liquids as in the case of another embodiment (not shown in FIG. 2), proper arrangement should be made so that printhead assembly 22 and printhead 24 for inks and the clear aqueous liquid will print on one side of the substrate while the printhead assembly 29 and printhead 27 for the aqueous inks and the clear aqueous liquid may print on the opposite side of the substrate.

In FIG. 2 a substrate (paper) cutter 36 can be optionally installed to cut the substrate to any desired length when a continuous web substrate is used. The substrate output tray (Duplex Output Tray, DOT) 37 is employed to receive the final product of printed substrates with images on both sides with reduced curl. If desired, the final product of print substrates can be stapled (not shown in FIG. 2) before its delivery to the output tray 37.

Various anti-curl agents may be used, if necessary, in the aqueous ink or inks and the clear aqueous liquid of the present invention and include different molecular weights of derivatives of glycerine (glycerol) propoxylates, glycerine (glycerol) ethoxylates, glycerine (glycerol) mixed ethoxylates and propoxylates, trimethylopropane propoxylates, trimethylopropane ethoxylates, trimethylopropane mixed ethoxylates and propoxylates, and other known anti-curl agents.

In the aqueous inks and the clear aqueous liquid of the present invention, the anti-curl agents are generally present in an amount of from about 0 to about 30% by weight of the ink, preferably from about 0 to about 20% by weight, and more preferably from about 0 to about 15% by weight, although the amounts can be outside these ranges.

The liquid vehicle of the aqueous inks and clear aqueous liquids employed for the process of the present invention may consist of water, or it may comprise a mixture of water and miscible or soluble organic components (humectants or solvents), such as glycol derivatives including ethylene glycols, propylene glycols, diethylene glycols, triethyleneglycol, dipropylene glycols, tripropyleneglycol, polyethylene glycols, polypropylene glycols; diols including petanediols (e.g. 1,5-pentanediol, etc.) and hexanediols (e.g., 1,6-hexanediol, etc.); triols including trihydroxyhexane(1,2,6-trihydroxyhexane), glycerine (glycerol), trimethylolpropane and their condensation products of ethyleneoxide and alkylethyleneoxides (e.g., glycerine (glycerol) propoxylate, glycerine (glycerol) ethoxylate, glycerine (glycerol) mixed ethoxylates and propoxylates, trimethylopropane propoxylate trimethylopropane ethoxylate trimethylopropane mixed ethoxylates and propoxylates; amides including N-alkylpyrrolidinones (N-methylpyrrolidinone, N-cyclohexylpyrrolidinone, etc.); urea; ethers including glycol ethers such as carbitol, butylcarbitol, cellusolve, etc.; polyglycolethers; carboxylic acids; esters; alcohols; organosulfides; organosulfoxides such as dimethylsulfoxide; sulfones including sulfolane; alcohol derivatives including isopropanol and alkylalcohols; ether derivatives; amino alcohols including ethanolamine, diethanolamine, and triethanolamine; ketones; betaine; and other water miscible or soluble materials, as well as mixtures thereof.

When mixtures of water and water miscible or soluble organic materials are selected as the liquid vehicle of the aqueous inks and the clear aqueous liquids, the water to organic ratio may be in any effective range, and typically is from about 100:0 to about 30:60, preferably from about 98:2 to about 40:60, and more preferably from about 97:3 to about 50:50, although the ratio can be outside these ranges. The non-water component of the liquid vehicle generally serves as a humectant or solvent, which has a boiling point higher than that of water (100° C.). In the aqueous inks and the clear aqueous liquids employed for the process of the present invention, the liquid vehicle is generally present in an amount of from about 50 to about 100.0 percent by weight, preferably from about 60 to about 98.0 percent by weight, and more preferably from about 70 to about 95.0 percent by weight, although the amount can be outside these ranges.

Various materials, humectants or mixtures thereof can be selected for the aqueous inks and the clear aqueous liquids of the present invention providing the objectives thereof are achievable. Important characteristics relating to the selection of an appropriate material or solvent include good compatibility with water; desirable vapor pressures; low toxicity properties; desirable intrinsic viscosities, for example, less than about 7 centipoises; surface tension values exceeding, for example, greater than 25 dynes/centimeter; and further, those materials in water will enable the substantially complete dissolution of the dye components (for inks only). Some specific examples of organic materials selected for the ink compositions and the clear aqueous liquids of the present invention include tetramethylene sulfone, available as Sulfolane®; 1,1,3,3-tetramethyl urea; 3-methyl sulfolane; 1,3-dimethyl-2-imidazolidone; and the like. Preferred materials, since they possess many desirable properties inclusive of substantially low toxicity characteristics, are sulfone derivatives such as sulfolane. Other materials may be selected providing the objects of the present invention are achievable including, for example foramides, and the like. The amount of the solvent may range from 0 to about 50 percent by weight, preferably from about 0.5 to 30 percent by weight, and more preferably from about 1.0 to 20 percent by weight, although the amount can be outside these ranges.

Preferred co-solvents or humectants are diols such as ethyleneglycol, propyleneglycol, polyethyleneglycol, polypropyleneglycol, etc. or triols such as glycerine (glycerol), trimethylolpropane (TMP), and their condensation products with ethyleneoxide and alkyleneoxides (e.g., propyleneoxide, butyleneoxide, etc.), sulfolane, and other previously mentioned humectants.

The colorant for the aqueous inks employed for the process of the present invention can be a dye. Examples of suitable dyes include anthraquinones, monoazo dyes, disazo dyes, phthalocyanines, aza[18]annulenes, formazan copper complexes, triphenodioxazines, Bernacid Red 2BMN; Pontamine Brilliant Bond Blue A; Pontamine; Food Black 1, Food Black 2; Carodirect Turquoise FBL Supra Conc. (Direct Blue 199), available from Carolina Color and Chemical; Special Fast Turquoise 8GL Liquid (Direct Blue 86), available from Mobay Chemical; Intrabond Liquid Turquoise GLL (Direct Blue 86), available from Crompton and Knowles; Cibracron Brilliant Red 38-A (Reactive Red 4), available from Aldrich Chemical; Drimarene Brilliant Red X-2B (Reactive Red 56), available from Pylam, Inc.; Levafix Brilliant Red E-4B, available from Mobay Chemical; Levafix Brilliant Red E-6BA, available from Mobay Chemical; Procion Red H8B (Reactive Red 31), available from ICI America; Pylam Certified D&C Red #28 (Acid Red 92), available from Pylam; Direct Brill Pink B Ground Crude, available from Crompton & Knowles; Cartasol Yellow GTF Presscake, available from Sandoz, Inc.; Tartrazine Extra Conc. (FD&C Yellow #5, Acid Yellow 23), available from Sandoz; Carodirect Yellow RL (Direct Yellow 86), available from Carolina Color and Chemical; Cartasol Yellow GTF Liquid Special 110, available from Sandoz, Inc.; D&C Yellow #10 (Acid Yellow 3), available from Tricon; Yellow Shade 16948, available from Tricon, Basacid Black X34, available from BASF, Carta Black 2GT, available from Sandoz, Inc.; Direct Brilliant Pink B (Crompton-Knolls); Kayanol Red 3BL (Nippon Kayaku Company); Levanol Brilliant Red 3BW (Mobay Chemical Company); Levaderm Lemon Yellow (Mobay Chemical Company); Spirit Fast Yellow 3G; Sirius Supra Yellow GD 167; Cartasol Brilliant Yellow 4GF (Sandoz); Pergasol Yellow CGP (Ciba-Geigy); Dermacarbon 2GT (Sandoz); Pyrazol Black BG (ICI); Morfast Black Conc A (Morton-Thiokol); Diazol Black RN Quad (ICI); Luxol Blue MBSN (Morton-Thiokol); Sevron Blue 5GMF (ICI); Basacid Blue 750 (BASF); Bernacid Red, available from Berncolors, Poughkeepsie, N.Y.; Pontamine Brilliant Bond Blue; Berncolor A. Y. 34; Telon Fast Yellow 4GL-175; BASF Basacid Black SE 0228; the Pro-Jet series of dyes available from ICI, including Pro-Jet Yellow I (Direct Yellow 86), Pro-Jet Magenta I (Acid Red 249), Pro-Jet Cyan I (Direct Blue 199), Pro-Jet Black I (Direct Black 168), Pro-Jet Yellow 1-G (Direct Yellow 132), Aminyl Brilliant Red F-B, available from Sumitomo Chemical Co. (Japan), the Duasyn line of "salt-free" dyes available from Hoechst, such as Duasyn Direct Black HEF-SF (Direct Black 168), Duasyn Black RL-SF (Reactive Black 31), Duasyn Direct Yellow 6G-SF VP216 (Direct Yellow 157), Duasyn Brilliant Yellow GL-SF VP220 (Reactive Yellow 37), Duasyn Acid Yellow XX-SF VP413 (Acid Yellow 23), Duasyn Brilliant Red F3B-SF VP218 (Reactive Red 180), Duasyn Rhodamine B-SF VP353 (Acid Red 52), Duasyn Direct Turquoise Blue FRL-SF VP368 (Direct Blue 199), Duasyn Acid Blue AE-SF VP344 (Acid Blue 9), and the like, as well as mixtures thereof. The dye is present in any effective amount, typically from about 0.1 to about 20 percent by weight, preferably for about 0.5 to about 10 percent by weight, and more preferably from about 1.0 to about 7.0 percent by weight, although the amount can be outside these ranges.

In addition, the colorant for the aqueous ink compositions of the present invention can be a pigment, or a mixture of one or more dyes and/or one or more pigments. The pigment can be black, cyan, magenta, yellow, red, blue, green, brown, mixtures thereof, and the like. Examples of suitable black pigments include various carbon blacks such as channel black, furnace black, lamp black, and the like. Colored pigments include red, green, blue, brown, magenta, cyan, and yellow particles, as well as mixtures thereof. Illustrative examples of suitable cyan pigments include copper tetra-4-(octadecyl sulfonamido) phthalocyanine, X-copper phthalocyanine pigment, listed in the color index as CI 74160, CI Pigment Blue, and Anthradanthrene Blue, identified in the Color Index as CI 69810, Special Blue X-2137, Hostaperm® Blue (a phthalocyanine derivative) and the like. Illustrative examples of yellow pigments that can be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Additional examples of pigments include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF) and Novoperm Yellow FG1 (Hoechst), Permanent Yellow YE 0305 (Paul Uhlich), Lumogen Yellow D0790 (BASF), Suco-Gelb L1250 (BASF) and Suco-Yellow D1355 (BASF). Illustrative examples of magenta pigments include Hostaperm® Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871 K (BASF), Paliogen Red 3340 (BASF), 2,9-dimethyl-substituted quinacridone and anthraquinone, identified in the color index as CI 60710 and Lithol Fast Scarlet L4300 (BASF). Additional suitable commercially available pigment dispersions include the Hostafine® pigments available from Hoechst Celanese Corporation, including Hostafine Black T, Hostafine Black TS, Hostafine Yellow HR, Hostafine Yellow GR, Hostafine Red FRLL, Hostafine Rubine F6B, and Hostafine Blue B2G, pigment dispersions available from Bayer company including Levanyl® Black A-SF, Levanyl® Yellow 5GXZ-SF, and the like, pigment dispersions available from Degussa Company including Derussol® carbon black pigment dispersions comprising Derussol® Z350S, Derussol® VU 25/L, Derussol® 345, and Derussol® 345OS, pigment dispersions available from BASF Corporation, including Disperse Black 006607, Luconyl® Yellow 1250, Basoflex Pink 4810, Luconyl Blue 7050, pigment dispersions available from Sun Chemical Corporation, including Sunsperse® 9303, Sunsperse® Red RHD 9365, Sunsperse® Magenta W83012, Aquatone® magenta, Aquatone® Blue, Aquatone® Yellow, and the like.

Other suitable pigments can also be selected. Pigment dispersions include carbon blacks, such as Hostafine® Black (T and TS), Sunsperse® 9303, and Levanyl® Black A-SF. Preferred pigments of this invention are nontoxic and AMES test negative materials (carbon blacks and color pigments) which include nonmutagenic and noncarcinogenic pigments for safety reasons. For example, it is desired to have pigments including carbon blacks and color pigments which have a very low concentration of polyaromatic hydrocarbons that are known to be carcinogenic or mutagenic. For illustrative purpose, nitropyrene, pyrene, tetracene, pentacene, and other polyaromatic hydrocarbons in many commericial carbon blacks and color pigments are considered to be toxic at a concentration greater than 5 parts per million. Thus, there is a need to limit the amount of toxic polyaromatic hydrocarbons content in pigments to less than 5 parts per million for preparation of nontoxic ink jet inks. Many commercial carbon blacks and pigments have a concentration of polyaromatic hydrocarbons exceeding 5 parts per million and, therefore, inks derived from them are generally considered to be toxic or failing to pass the AMES test. However, many nontoxic carbon blacks and color pigments including Raven® 5250, Raven® 5750, Regal® 330, Black Pearl® 1300, Black Pearls® L, Vulcan® XC-7, Hostapern® pink E, Hostaperm® blue (a phthalocyanine derivative) and other pigments contain polyaromatic hydrocarbons in concentrations below 5 parts per million and, therefore, are suitable for use in the present invention. Preferable pigments are those that have a polyaromatic hydrocarbon content of less than 1 part per million. They do not show positive response in AMES test and are considered to be safe in toner and ink jet ink applications. These nontoxic carbon blacks and color pigments with low polyaromatic hydrocarbon content (at least less than 5 parts per million) are not readily available from the marketplace and they are specially prepared for Xerox Corporation and are extremely useful for the preparation of nontoxic ink jet inks of this invention.

The color fidelity (e.g. hue, color gamut, optical density, etc.) of the aforementioned pigments and pigment dispersions can be modified, if necessary, with many known dyes including Food Black No. 1, Food Black No. 2, Direct Black 168, Acid Blue 9, water soluble copper phthalocyanine derivatives including copper phthalocyanine tetrasulfonate sodium salt, etc., Acid red 52, Acid yellow 17, Tartrazine yellow, Project cyan, Project magenta, Project yellow, and the like. However, in this invention the majority of the color of the ink jet image is provided by the pigment colorants in the inks.

According to the present invention, pigment dispersions prepared by the process set forth herein may be employed in the ink compositions for ink jet printing. Such dispersions for the preparation of pigment inks are provided by mixing pigments with at least a dispersant or a dispersing agent selected from anionic, cationic, nonionic dispersants, and compatible mixtures thereof (e.g. mixtures of anionic and nonionic dispersants, mixtures of cationic and nonionic dispersants), water as well as other optional chemical additives. The pigments may include those listed herein in addition to other pigments, such as Hostaperm Pink, CI Pigment Red 9, 146 and 184, Phthalocyanine (CI Pigment Blue 15, 15:4, etc.), metal phthalocyanine derivatives (e.g., copper phthalocyanine and its derivatives, vanadyl phthalocyanine, or metal-free phthalocyanines, etc.), CI Pigment Yellow 13, 83, 85, etc., Direct Yellow 157, etc., and carbon blacks including Raven® 5250, Raven® 5750, Black Pearls® L, Black Pearls® 1300, Regal® 330, Vulcan® XC-72C, etc. One of the preferable pigments according to the present invention is carbon black such as Regal® 330 available from Cabot Company, and Raven® 5750 and Raven 5250® available from Columbian Chemical Corporation.

Preferably, the pigment particle size in the aqueous inks or dispersions is as small as possible to enable a stable colloidal suspension of the particles in the liquid vehicle with good color strength and to prevent clogging of the ink jet channels or nozzle openings when the ink is used in a thermal ink jet printer. Average particle sizes are generally from about 0.001 to about 5 microns, preferably from about 0.01 to about 3 microns, and more preferably from about 0.01 to about 1.2 microns, although the particle size can be outside these ranges. A more preferred pigment particle size in the inks of this invention includes particles having at least 50% of the particles being below 0.3 micron with no particles being greater than 3.0 microns (measured on a Hodaka CAPA 700 Particle Size Analyzer). More preferably, the pigment particle size of the ink includes particles having at least 70% of the particles being below 0.3 micron with no particles being greater than 1.0–1.2 micron. The pigments may be sonified, centrifuged and filtered to provide the desired particle size. The pigment is present in the ink composition in any effective amount, generally from about 1 to about 20 percent by weight, preferably from about 2 to about 10 percent by weight, and more preferably from about 4 to about 8 percent by weight, although the amount can be outside of these ranges.

According to the present invention, the pigment in the aqueous inks is dispersed in water with one or more dispersants. The dispersants can be anionic, cationic, and nonionic types especially those ionic dispersants which have both ionic (capable of ionization in water) and hydrophobic (affinity for pigments) moieties. Suitable dispersants include anionic dispersants, such as polymers and copolymers of styrene sulfonate salts (e.g., Na+, Li+, K+, Cs+, Rb+, substituted and unsubstituted ammonium cations, etc.) or naphthalene sulfonates salts, (e.g., Na+, Li+, K+, Cs+, Rb+, substituted and unsubstituted ammonium cations, etc.), products comprising unsubstituted and substituted (e.g. alkyl, alkoxy, substituted naphthalene derivatives, etc.) naphthalene sulfonate salts (e.g., Na+, Li+, K+, Cs+, Rb+, substituted and unsubstituted ammonium cations, etc.) and aldehyde derivatives (e.g., unsubstituted alkyl aldehyde derivatives including formaldehyde, acetaldehyde, propylaldehyde, etc.), and their mixtures as well as their water solutions. Such dispersants include commercial products such as Lomar® D, Daxad®19, Daxad® K, Tamol® SN, and the like. The more preferable dispersants comprise naphthalene sulfonate salts, especially a condensation product of naphthalenesulfonic acid and formaldehyde, and its salts (e.g., Na+, Li+, K+, Cs+, Rb+, substituted and unsubstituted ammonium cations, etc.) thereof. Also nonionic dispersants or surfactants may be utilized comprising ethoxylated monoalkyl or dialykyl phenols including Igepal® CA and CO series (e.g. Igepal® CA-630, Igepal® CO-630, etc.) materials from Rhone-Poulenc Co., and Triton® series materials from Union Carbide Company. These nonionic surfactants or dispersants can be used alone or in combination with the aforementioned anionic dispersants (e.g. products comprising aforementioned naphthalene sulfonate salts and formaldehyde, etc.). The nonionic dispersants can also be used alone or in combination with one or more cationic dispersant in dispersing pigments in water. The ratio of pigment to aforementioned pigment dispersant (s) according to the present invention ranges from about 1/0.01 to about 1/3, preferably from about 1/0.1 to about 1/1, and more preferably from about 1/0.15 to about 1/0.5. The amount of naphthalene substituent to aldehyde (e.g. formaldehyde, acetaldehyde, etc.) in the aforementioned anionic dispersant is generally about 1 to 1, although this ratio can be different depending on the stoichmetry of the feed stock and reaction conditions and it is readily adjusted to obtain a dispersant having a desired molecular weight and the desired ratio of naphthalene substituent to aldehyde. The remainder of the dispersion may comprise nonactive ingredients such as water, solvent or humectant and chemical additives. The average molecular weight of the dispersant is generally less than 20,000, preferably less than 13,000, and more preferably less than 10,000. The pigment dispersion should contain enough dispersant to stabilize the pigment particles in water and ink, but not so much as to adversely affect properties of the dispersion such as viscosity, stability, and optical density.

According to the present invention, pigment dispersions for aqueous pigment inks may be prepared by mixing at least one dispersant (e.g., a product of formaldehyde and sodium naphthalene sulfonate or a product of an aldehyde and a derivative of naphthalene sulfonic acid salt, etc. ), pigment, and water in a mixer such as an attritor, sandmill, homogenizer, fluidizer including a microfluidizer, high speed mixer, and the like, with or without an optional grinding medium, such as stainless steel balls, ceramic chips, and the like. Proper pigment to dispersant ratio as mentioned previously and adequate grinding (milling) time are needed to reduce particle size of the pigment to provide a suitable pigment dispersion.

Other chemical additives can also be present in the aqueous inks and the clear aqueous liquids of the present invention. For example, surfactants or wetting agents can be added to the ink. These additives may be of the cationic, anionic, or nonionic types. Suitable surfactants and wetting agents include Tamol SN®, Tamol LG®, those of the Triton® series available from Rohm and Haas Co., those of the Marasperse® series, those of the Igepal® series available from Rhone Poulenc Co. (formerly from GAF Co.), those of the Tergitol® series, those of the Duponol® series available from E. I. Du Pont de Nemours & Co., Emulphor® ON 870 and ON 877, available from GAF, and other commercially available surfactants. These surfactants and wetting agents are present in pigment inks or dispersions in effective amounts, generally from 0 to about 15 percent by weight, preferably from about 0.01 to about 10 percent by weight, and more preferably from about 0.02 to about 8 percent by weight, although the amount can be outside these ranges.

Polymeric chemical additives can also be added to the inks and the clear aqueous liquids employed in the process of the present invention to enhance the viscosity of the ink and the clear aqueous liquids, including water soluble polymers such as Gum Arabic, polyacrylate salts, polymethacrylate salts, polyvinyl alcohols, hydroxy propylcellulose, hydroxyethylcellulose, polyvinylpyrrolidinone, polyvinylether, starch, polysaccharides, polyethyleneimines derivatized with polyethylene oxide and polypropylene oxide, such as the Discole® series available from DKS International, Tokyo, Japan, the Jeffamine® series available from Texaco, Bellaire, Tex., and the like. Polymeric additives may be present in the ink or the clear aqueous liquids of the present invention in amounts of from 0 to about 10 percent by weight, preferably from about 0.001 to about 8 percent by weight, and more preferably from about 0.01 to about 5 percent by weight, although the amount can be outside these ranges.

Other optional additives to the inks and the clear aqueous liquids employed in the process of the present invention include biocides to inhibit bacteria growth such as Dowicil® 150, 200, and 75, undecylenic acid salts, benzoic acid salts, ascorbyl palmitate, propionic acid salts, sorbic acid salts, Proxcel® Series from ICL, and the like, present in an amount of from about 0.0001 to about 10 percent by weight, preferably from about 0.001 to about 8 percent by weight, and more preferably from about 0.01 to about 4.0 percent by weight, although the amount can be outside these ranges; penetration control additives (or penetrants) such as alcohol ether derivatives including alkylcarbitols such as propylcarbitol®, butylcarbitol® and hexylcarbitol®, ethyleneglycol alkyl ethers, propyleneglycol alkylethers, diethyleneglycol alkyl ethers including diethyleneglycol hexyl ether, polyethylenecol alkylethers, polypropyleneglycol alkylethers, alkylpyrrolidinone derivatives including N-methylpyrrolidinone, N-hexylpyrrolidinone, 1-dodecyl-2-pyrrolidinone, alkyltoluamide derivatives including N,N-diethyl toluamide, alkylamide derivatives, benzyl alcohol, and the like, and mixtures thereof present in an amount of from 0 to about 25 percent by weight, preferably from about 0.01 to about 20 percent by weight, and more preferably from about 0.01 to about 15 percent by weight, although the amount can be outside these ranges; pH controlling agents such as acids or bases, phosphate salts, carboxylates salts, sulfite salts, amine salts, and the like, present in an amount of from 0 to about 10 percent by weight, preferably from about 0.001 to about 5 percent by weight, and more preferably from about 0.01 to about 4 percent by weight, although the amount can be outside these ranges; or the like. Other optional ingredients in the inks or the clear aqueous liquids include chelating agents. The concentration of the ingredients can be varied from about 0 to about 10 percent, preferably from about 0.1 to about 8 percent, and more preferably from about 0.1 to about 5 percent by weight in the ink.

Other examples of suitable ink or clear aqueous liquid additives include those disclosed in U.S. Pat. No. 5,223,026 and U.S. Pat. No. 5,207,825, the disclosure of each of which is totally incorporated herein by reference.

The aqueous inks and the clear aqueous liquids of the present invention may contain an ionic compound other than dye at least partially ionizable in the liquid vehicle for desired coupling with microwave for drying. Preferably, the ionic compound is selected so that a relatively small amount is in the ink to obtain the desired conductivity. For example, it is preferred that the ionic compound exhibit a high degree of dissociation in the aqueous liquid vehicle of the ink and the clear aqueous liquids, since a higher degree of dissociation results in more free ions present in the liquid and thus results in higher conductivity for a given molar amount of the ionic compound. Generally, preferred ionic compounds exhibit a degree of dissociation of about 100 percent, although ionic compounds exhibiting lower degrees of dissociation can also be used.

The ionic compound can be an acid, a base, or a salt. Typical cations include but are not limited to H+, Li+, Na+, K+, $Mg^{2+}$, $Ca^{2+}$, $Fe^{2+}$, $Fe^{3+}$, $Al^{3+}$, $NH^{4+}$, and the like. Typical anions include but are not limited to OH—, $F^-$, $Cl^-$, $Br^-$, $I^-$, $NO_3$—, $SO_4^{2-}$, $CH_3COO$—, and the like. Specific examples of suitable acids include but are not limited to HCl, HBr, HI, $HNO_3$, $H_2SO_4$, acetic acid, and the like. Specific examples of bases include but are not limited to LiOH, NaOH, KOH, $Mg(OH)_2$, $Ca(OH)_2$, $Fe(OH)_2$, $Fe(OH)_3$, $Al(OH)_3$, $NH_4OH$, and the like. Specific examples of suitable salts include but are not limited to NaCl, KI, $NH_4I$, $NH_4Br$, $NH_4HCO_3$, NaI, $NaNO_3$, $(NH_4)_2SO_4$, $NH_4Cl$, LiCl, and the like.

Generally, ionic compounds that enable higher ink conductivity per weight unit of ionic compound present in the ink and the clear aqueous liquids are preferred in conjunction with the use of microwave heaters for drying the inks and the clear aqueous liquids. For example, compounds containing low molecular weight cations and anions generally result in higher conductivity per weight unit of compound present in the ink and the clear aqueous liquids than do ionic compounds containing high molecular weight cations and anions. Thus, an ink or a clear aqueous liquid containing 1 percent by weight of lithium chloride exhibits higher conductivity than an ink containing 1 percent by weight of potassium iodide, since the ink containing lithium chloride contains more free ions per unit of weight than the ink containing potassium iodide. Ionic compounds wherein only a small amount is required in the ink or the clear aqueous liquid to achieve the desired conductivity are particularly preferred when the other ink components or characteristics, such as the dye or the pigment colloidal dispersion stability, can be adversely affected by the presence of large amounts of ions. The optional use of the ionic compound preferably is selected to optimize solubility of the other ingredients.

The amount of the ionic compound other than dye present in the aqueous ink or the clear aqueous liquid for microwave drying can vary. Typically, the ink contains from about 0 to about 20 percent by weight of the ionic compound other than dye; for inorganic and organic salts, preferably the ink contains from about 0.01 to about 10-percent, and more preferably from about 0.1 to about 5 percent by weight of the ionic compound, although the amounts can be outside of these ranges provided that the conductivity objectives for drying of the present invention are achieved. The amount of the ionic compound present generally will also depend on the size and valency of the ions in the compound, the desired printing process speed, the desired ink conductivity, the size of the image with respect to dimensions and ink deposition density (milligrams per square centimeter) on paper, the power level of the microwave drying apparatus, and the like.

Proper amounts of the microwave coupling ionic compounds or salts should be used in the aqueous inks and the clear aqueous liquids of the present invention. Excessive conductivities, however, can adversely affect ink characteristics in that ink components such as dyes can be rendered insoluble in the liquid vehicle at high salt concentrations. In addition, at high conductivities, solid areas of images can boil and splatter due to microwave overheating.

Aqueous ink compositions according to the present invention may be provided by mixing aforementioned pigment dispersions with the previously mentioned solvents, humectants, and other ink additives (or ingredients). The mixing can be done by various methods including homogenizing, sonification, microfluidization, mechanical mixing, magnetic stirring, high speed jetting, and the like. The sonification or homogenizing process is preferred since such process provides a homogeneous dispersion of pigment particles by evenly distributing the dispersant throughout the pigment ink. Microfluidization can also be used for large scale production of the pigment dispersion and inks.

After formation of the pigment dispersion, pigment inks suitable for the present invention can be prepared by any process suitable for preparing aqueous-based inks. For example, the ink ingredients can be mixed in the desired amounts and stirred until a uniform ink composition results (typically about 30 minutes, although the mixing/stirring time can be either greater or less than this period). While not required, the ink ingredients can be heated during mixing if desired. Subsequent to mixing and stirring as well as centrifugation, the ink composition generally is filtered to remove any solid or particulate matter greater than 3.0 microns. Any other suitable processes for preparing the inks may also be employed.

According to the invention, the surface tension of the aqueous inks and the clear aqueous liquids are greater than 25 dynes/cm, preferably greater than 30 dynes/cm and more preferably greater than 35 dynes/cm, although it may be outside this range. The viscosity of the ink or the clear aqueous liquids is usually less than 20.0 cps, preferably less than 10.0 cps, and more preferably less than 5.0 cps.

The aqueous inks or the clear aqueous liquids of the present invention possess excellent latency. Generally, the inks possess a latency of at least 10 seconds, more preferably on the order of 20 seconds to greater than 1000 seconds, with a minimum latency of at least 20 seconds being preferred when a 600 spi printhead is employed.

The aqueous ink and the clear liquid are applied to a suitable substrate in an image-wise fashion. Application of the, ink to the substrate can be conducted by any suitable printing process compatible with aqueous-based inks, such as pen plotters, continuous stream ink jet printing, drop-on-demand ink jet printing (including piezoelectric, acoustic and thermal ink jet printing processes), or the like. Single pass as well as multiple pass or checkerboarding ink jet printing processes may be used to create color and/or black images on the substrate. Checkerboarding in combination with heat and delay techniques are preferred. The heat can be provided to the substrate by any known heating means including a heated belt, platen, roll, lamp, radiant heater, microwave heater, laser diodes, and the like, either with or without the assistance of vacuum and/or hot circulated air. Preferably, microwave heaters are utilized when employing the ionic ink additive. Suitable ink jet printers employing microwave dryers include those disclosed in U.S. Pat. No. 5,220,346 to Carreira et al., the subject matter of which is totally incorporated herein by reference.

The ink jet printing processes and the compositions of the aqueous inks and the clear aqueous liquids of this invention can have a broad scope and a wide variations. The following examples are provided only for illustrative purposes. Other variations of the ink jet printing process and the compositions of the aqueous inks and the clear aqueous liquids for curl reduction can also be employed by those skilled in the art and are also included within the spirit and the scope of this invention.

EXAMPLES

In Examples I, II, III, and IV a Hewlett Packer HP-1200C color thermal ink jet ink jet printer is employed. A substrate is heated (using radiant heaters) during printing either with or without checkerboarding. Printing modes, such as a) Paper-fast mode (single pass without checkerboarding, PF), b) High Quality mode (checkerboarding and heat in HQ mode) and c). Normal mode (checkerboarding and heat, N mode) are employed to print a large solid area (8 1/16"×10¼") on a 8½"×11" paper with four surrounding white boarders. Hewlett Packer HP-1200C black and color inks (carbon black ink, cyan, magenta, and yellow dye inks), CH 3 color set aqueous inks (cyan, magenta, and yellow dye inks), new inks, and a clear aqueous liquid are employed in the demonstrations of the present invention. Various plain papers with different sizing, paper weight, and fabrication process (Alkaline or Acidic process) are used. After the application of water, the papers with or without ink jet image are allowed to dry at least overnight before measuring the curl properties.

Paper curl data are obtained in terms of curl radius, average paper heights for four corners of a paper, and average paper height near the centers of the long side of a paper (centers of 11" sides). The curve radius is obtained by a free hanging method. A paper clip is attached to the center of a paper (short side, 8½" side) being measured and allowed the paper to freely suspend in the air. The curvature of the paper curl is determined by matching the paper curling shape near the edge with a template which had curves of known radius of curvature. A large number of curl radius indicates less paper curl.

Average paper corner height was determined by placing a paper imaged with an ink jet ink or a clear aqueous liquid on a flat surface and the sum of the heights for four corners are obtained and divided by four. A large number of average paper corner height represents a severe paper curl problem (all A cases in Tables II and III). A small number of the average paper height indicates low paper curl (desirable, all B cases in Tables II and III). Likewise, average paper center height was also determined similarly except the center heights on the long sides (along 11" side of a 8½"×11" paper) of a paper are measured and averaged. A small number reflects low curl.

Example I

Paper curl is formed by printing solid area on papers with either water or an ink comprising water. A clear aqueous liquid comprising water and a small amount (@0.01%) of surfactant (Igepal CO-630) is prepared. The clear aqueous liquid has a surface tension of 33.5 dyne/cm at room temperature. The clear aqueous liquid is placed into a cleaned and empty HP-1200C cyan ink cartridge for the printing to demonstrate the effect of water on paper curl (Table I). Several plain papers are printed with the clear water liquid using a HP-1200C printer in a high quality mode (HQ mode). The HQ mode employs heat and checkerboarding (partial tone printing) method during printing. Paper curl is less severe with the HQ mode printing as compared to Paper Fast mode, which delivered ink on paper in a single swath for solid area printing. Even with the preferred HQ mode, paper curl caused by printing a clear aqueous liquid or an ink jet ink comprising water is observed (see Tables I, II and III). The paper curl can be reduced by the process of this invention (see Table I, II, III, and IV).

TABLE I

Paper Curl Generated by Printing Solid Area on Papers With Water

| Paper Type | Curl Radius Inch | Printing Mode | Paper Height Corners cm | Paper Height Centers cm |
|---|---|---|---|---|
| 1. Image Series LX | 5" | HQ | Ave. = 1.8 cm | Ave. = 1.8 cm |
| 2. Image Series Smooth (ALk.) | 3" | HQ | Ave. = 4.2 cm | Ave. = 4.4 cm |
| 3.Hammermill Fore DP V3 | 5" | HQ | Ave. = 2.4 cm | Ave. = 2.3 cm |
| 4. Xerox 4024 DP Cortland | 2" | HQ | Ave. = 5.3 cm | Ave. = 5.3 cm |

TABLE I-continued

Paper Curl Generated by Printing Solid Area on Papers With Water

| Paper Type | Curl Radius Inch | Printing Mode | Paper Height Corners cm | Paper Height Centers cm |
|---|---|---|---|---|
| 5. Xerox Recycled Paper | 3" | HQ | Ave. = 4.2 cm | Ave. = 4.4 cm |
| 6. Gilbert Bond Paper | 5" | HQ | Ave. = 2.7 cm | Ave. = 2.7 cm |

Curl: Curl is Toward image. Drop mass=55 ng/drop, RH=34%, HQ=High quality mode. This example shows that printing with water causes paper curl.

Example II

A CH 3 set of aqueous color inks (CH 3 cyan ink, CH 3 magenta ink, and CH 3 yellow ink) are prepared and used in paper curl studies. The compositions of these inks in weight percentage are shown below. 1). CH 3 cyan ink: Project cyan dye (ICI 10% liquid dye concentrate, 35.0% solid), butylcarbitol (10.0%), N-cyclopyrrolidinone (2.0%), sulfolane (15.0%), polyethyleneoxide (0.07%), and water (balance). 2). CH 3 Magenta ink: Mitubishi magenta dye (4.0%), butylcarbitol (10.0%), N-cyclopyrrolidinone (2.0%), sulfolane (15.0%), polyethyleneoxide (0.05%), and water (balance). 3). CH 3 yellow ink: Project yellow 1G (4.0%), butylcarbitol (10.0%), N-cyclopyrrolidinone (2.0%), sulfolane (15.0%), polyethyleneoxide (0.03%), and water (balance). Printing solid area with these inks on one side of a paper causes the formation of paper curl which can be minimized by this invention.

Hewlett Packard HP-1200C ink jet inks (Cyan, Magenta, Yellow, dye inks and carbon black pigment ink) are also employed in solid area printing to generate paper curl, which is significantly reduced by the process of this invention.

Different aqueous inks and clear aqueous liquid are printed on different plain papers with a HP-1200C thermal ink jet printer and the printed samples are dried at least overnight under the laboratory conditions to allow the papers to reach equilibrium.

The clear aqueous liquid of the present invention including water and a small amount (@0.01%) of surfactants (Igepal CO-630) is used in printing the back side of a paper which was previously imaged by a thermal ink jet method with an aqueous ink (e.g. HP-1200C ink jet ink) and showed curl upon aging. The results of curl reduction for the back side printing of the papers containing ink jet images (front side) using a clear aqueous liquid are shown in Tables II and III. In all A cases (e.g. 1A, 2A, 3A, . . . etc.) the paper curl was generated by printing an ink jet ink on one side of paper only followed by air drying under ambient conditions. All papers showed paper curl at different levels after the printing and aging under laboratory conditions. Various degrees of curl are observed depending on the type of ink, paper, and mode of printing. In the worst case, the imaged paper forms a scroll or a roll (a severe case) which is not measurable. After the back printing the imaged papers with the clear aqueous liquid of the present invention (shown in Example IV, all B cases in Tables II and IV) and drying, significant reduction of paper curl is observed in all cases (all B cases (e.g. 1B, 2B, 3B, . . . etc.)). The results are shown in Tables II and III. The data strongly indicates that a clear aqueous liquid of the present invention can be used effectively to minimize the paper curl without disturbing previously generated images.

TABLE II

Reduction of Paper Curl By Back Printing of Previously Imaged Papers With a Clear Aqueous Liquid of the Present Invention

| Paper Type | Curl Radius (Show Through) | Paper Height Corners cm | Paper Height Centers cm | Remark First printing with an aqueous ink/ Back printing with a clear aqueous liquid or ink | Mode First printing mode/ Back printing mode |
|---|---|---|---|---|---|
| 1A. Xerox Recycled Paper | 1"(Tl), Scroll (0.09) | Not Measurable | Not Measurable | HP-1200 C Blue/None | PF |
| 1B. Xerox Recycled Paper | >30" (0.0) | Ave. = 0.4 cm | Ave. = 0 cm | HP-1200 C Blue/$H_2O$ | PF/HQ |
| 2A. Gilbert Bond Paper | 5"(Tl) (0.07) | Ave. = 2.4 cm | Ave. = 2.6 cm | CH 3 Cyan Ink/None | HQ |
| 2B. Gilbert Bond Paper | 7"(Tl) (0.0) | Ave. = .15 cm | Ave. = 0.1 cm | CH 3 Cyan Ink/$H_2O$ | HQ/HQ |
| 3A. Image Series Smooth | 2"(Tl) (0.06)) | Not Measurable | Not Measurable | HP-1200 C Bk/ None | HQ |
| 3B. Image Series Smooth | 27"(Tl) (0.0) | Ave. = 0.5 cm | Ave. = 0.1 cm | HP-1200 C Bk*/$H_2O$ | HQ/HQ |
| 4A. Image Series Smooth | 3"(Tl) (0.0) | Ave. = 4.2 cm | Ave. = 4.4 cm | $H_2O$+/None | HQ |
| 4B. Image Series Smooth | >30"(Tl) (0.0) | Ave. = 0.15 cm | Ave. = 0.1 cm | $H_2O$+/$H_2O$ | HQ/HQ |
| 5A. Xerox 4024 DP, V8 | Scroll (Tl) (0.13) | Not Measurable | Not Measurable | CH 3 Cyan Ink/None | PF |
| 5B. Xerox 4024 DP, V8 | 15"(Tl) (0.0) | Ave. = 0.78 cm | Ave. = 0.7 cm | CH 3 Cyan ink/$H_2O$ | PF/HQ |

RH=30%; Black Printing With Water (clear aqueous liquid), Surface Tension 33.5 dyne/cm; PF=Paper fast, single pass mode with heat; HQ=High quality mode (Heat and checkerboarding); *Carbon Black Ink.; +Water only in the first printing.; None in 5th columns means there is no back printing.

TABLE III

Reduction of Paper Curl By Back Printing An Imaged Paper With a Clear Aqueous Liquid of the Present Invention

| Paper Type | Curl Radius (Show Through) | Paper Height Corners cm | Paper Height Centers cm | Remark First printing ink/ Back printing liquid or ink | Mode First printing mode/ Back printing mode |
|---|---|---|---|---|---|
| 6A. Image Series Smooth (Alkaline) | Scroll (Tl) 0.09 | Not Measurable | Not Measurable | CH 3 Magenta/ None | N |
| 6B. Image Series Smooth (Alkaline) | 5"(Tl) 0.0 | Ave. = 1.3 cm | Ave. = 1.5 cm | CH 3 Magenta/$H_2O$ | N/HQ |
| 7A. Xerox 4200 GP Pensacolola | Scroll (Tl) 0.11 | Not Measurable | Not Measurable | CH 3 Red/None | HQ |
| 7B. Xerox 4200 GP Pensacolola | 29"(Tl) 0.0 | Ave. = 0.7 cm | Ave. = 0.2 cm | CH 3 Red/$H_2O$ | HQ/ HQ |
| 8A: Xerox 4200 GP Pensacolola | 4–5"(Tl) 0.06 | Ave. = 2.4 cm | Ave. = 2.5 cm | CH 3 Yellow/None | HQ |
| 8B. Xerox 4200 GP Pensacolola | >30"(Tl) 0.0 | Ave. = 0.15 cm | Ave. = 0.0 cm | CH 3 Yellow/$H_2O$ | HQ/ HQ |
| 9A. Xerox 4200 GP Pensacolola | 4–5"(Tl) 0.08 | Ave. = 2.2 cm | Ave. = 2.3 cm | CH 3 Magenta/None | HQ |
| 9B. Xerox 4200 GP Pensacolola | >30"(Tl) 0.0 | Ave. = 0.1 cm | Ave. = 0.0 cm | CH 3 Magenta/$H_2O$ | HQ/HQ |

RH=30%, Back Printing With Water, Surface Tension=33.5 dyne/cm; PF=Paper fast, single pass mode with heat; HQ=High quality mode (Heat and checkerboarding); N=Normal mode with heating; Red is a composite color comprising magenta and yellow inks; In all B cases, the imaged papers are back printed with a liquid comprising water to reduce curl.

Example III

Solid area printing on a plain paper with an ink jet ink causes undesired paper curl upon aging. By printing the back side of the imaged papers (previously imaged with a thermal ink jet printing method using at least an aqueous ink jet ink) with an aqueous ink jet ink (e.g. CH 3 Magenta ink, CH Cyan ink, HP-1200C inks, etc.) comprising water, paper curl is significantly reduced. The reduction of paper curl is possibly due to the decrease of the differential stress between the top and bottom surfaces of a paper caused by water in the aqueous inks. This Example shows in many cases (cases 1, 4, and 5) that the curl reduction is achieved by printing the back side of an imaged paper with an aqueous ink jet ink (either the same (case 2) or different ink (all other cases) from the first printing ink) comprising water. The color ink composition and mode of printing can be either the same or different between the first printing ink and the second printing ink. Back side printing of an imaged paper (DUPLEX printing) can be carried out in any desired pattern including partial tone (¼ tone, ½ tone, text, graphic, etc.) and full tone (solid area) as long as the reduction of paper curl of this invention is achieved. In this Example back printing with full tone (solid area printing) image is employed to simulate a severe case for demonstration purposes. The clear aqueous liquid of the present invention is not used in this demonstration. The results are shown in Table IV. Ink known to cause paper curl in single side printing (symbol *) does not give bad paper curl in the two sided ink jet printing (Duplex ink jet printing). Duplex ink jet printing has been shown to be desirable not only for saving paper consumption but also reduces paper curl as demonstrated in this Example. Ink jet printing on the substrates was carried out either with a checkerboarding mode (e.g. HQ=High Quality Checkerboarding Mode) or a single pass mode (e.g. PF=Paper Fast Mode).

TABLE IV

Reduction of Paper Curl by Back Printing an Imaged Paper with an Aqueous Ink Jet Ink of the Present Invention

| Paper Type | Paper Height Corners cm Single Side Printing/ Double Side Printing | Paper Height Centers cm Single Side Printing/ Double Side Printing | Remark First printing ink/Back printing with an ink jet ink | Mode First printing mode/ Back printing mode |
|---|---|---|---|---|
| 1A. Image Series Smooth (Alkaline) | Severe Curl, Scroll*/ Ave. = 2.45 cm | Severe Curl, Scroll*/ Ave. = 2.60 cm | CH 3 Magenta Ink*/HP-1200C Yellow Ink | PF/PF |
| 2 Xerox Recycled Paper | Severe Curl*/ Ave. = 0.10 cm | Severe Curl*/ Ave. = 0.08 cm | CH 3 Magenta Ink*/CH 3 Magenta Ink | HQ/HQ |
| 3. Xerox Recycled Paper | Slight Curl*/ Ave. = 0.10 cm | Slight Curl*/ Ave. = 0.05 cm | HP-1200C Cyan Ink/CH 3 Cyan Ink | HQ/HQ |
| 4. Hammermill Tital DP Oswego | Severe Curl, Scroll*/ Ave. = 0.80 cm | Severe Curl, Scroll*/ Ave. = 0.75 cm | HP-1200C Black Ink*/CH 3 Magenta Ink | HQ/HQ |
| 5. Hammermill Fore DP | Severe Curl, Scroll*/ Ave. = 0.83 cm | Severe Curl, Scroll*/ Ave. = 0.80 cm | HP-1200C Cyan Ink*/CH 3 Magenta Ink | PF/HQ |
| 6. Gilber Bond | Slight Curl*/ Ave. = 0.0 cm | Slight Curl*/ Ave. = 0.0 cm | HP-1200C Cyan Ink/CH 3 Magenta Ink | HQ/HQ |

This Example demonstrates that back printing with an ink jet ink significantly reduces curl; PF=Paper fast, single pass mode with heat; HQ=High quality mode (Heat and checkerboarding); N=Normal mode with heating; * Denote as single side printing with the first ink which sometimes causes severe paper curl upon aging to form a scroll. The curl can be reduced by back side printing with an ink comprising water. The symbol "/ " signifies printing with a 2nd ink, mode of printing, and curl reduction for the use of an aqueous ink jet ink in the back side printing. This example is a repeating of the process for single sided ink jet printing to achieve visible images on both sides of a substrate with a reduced curl.

What is claimed is:

1. A process for the reduction of curl in duplex ink jet printing comprising the steps of:

(a) applying at least one first aqueous ink in an image-wise fashion to a first side of a substrate to provide a first visible image, (b) applying at least one first clear aqueous liquid to a second, opposite side of the substrate, (c) applying at least one second aqueous ink in an image-wise fashion to the second, opposite side of the substrate to provide a second visible image, and (d) applying at least one second clear aqueous liquid to the first side of the substrate, wherein the first and second aqueous inks are the same or different and comprise water, a colorant of dye or pigment, and at least one ingredient selected from the group consisting of anticurl agent, biocide, pH buffering agent, antioxidant, antikogation agent, anticockling agent, penetrant, bubble nucleation aid, microwave coupling agent or salt, surfactant and dispersing agent, and wherein the first clear aqueous liquid comprises water and at least one ingredient, the at least one ingredient being the same as the at least one ingredient of the first aqueous ink with the exception that the first clear aqueous liquid does not contain any colorant, and wherein the second clear aqueous liquid comprises water and at least one ingredient, the at least one ingredient being the same as the at least one ingredient of the second aqueous ink with the exception that the second clear aqueous liquid does not contain any colorant.

2. A process according to claim 1, wherein the applying of the first or second aqueous ink or the first or second clear aqueous liquid in image-wise fashion is carried out by a thermal ink jet printing method that uses one or more ink jet printhead according to the command of digital signals in a printer to produce patterns.

3. A process according to claim 1 wherein said substrate is at least one member selected from the group consisting of a plain paper, a recycled paper, an ink jet paper, a coated paper, and a plastic sheet in either a cut sheet or a web form.

4. A process according to claim 1, further comprises the steps of providing a single pass printing method or a checkerboard printing method to deliver the first and second aqueous ink and the first and second clear aqueous liquid on said substrate.

5. A process according to claim 1, wherein said applying steps of the first and second aqueous ink and the first and second clear aqueous liquid are performed by a continuous ink jet printing method or a drop-on-demand ink jet printing method.

6. A process according to claim 1, further comprises the step of including said biocide comprising at least one member selected from the group consisting of propionic acid salts, undecylenic acid salts, sorbic acid salts, Dowicil® derivatives, Proxel® Series derivatives, benzoic acid salts, ascorbyl palmitate, and mixtures thereof.

7. A process according to claim 1, further comprises the step of including said surfactant or dispersing agent comprising at least one member selected from the group consisting of alkylsulfonate salts and ammonium lauryl sulfonates, alkylphenyl ethers of polyethyleneglycols, Triton® Series surfactants, alkylphenyl ethers of propylene glycols, alkyl polyethyleneglycols, and condensation products of a naphthalene sulfonate salt and formaldehyde, and mixtures thereof.

8. A process according to claim 1, further comprises the step of including said penetrant comprising at least one member selected from the group consisting of alcohol ether derivatives, ethyleneglycol alkyl ethers, propyleneglycol alkylethers, diethyleneglycol alkyl ethers, polyethyleneglycol alkylethers, polypropyleneglycol alkylethers, alkylpyrrolidinone derivatives, alkylamide derivatives and mixtures thereof.

9. A process according to claim 1, further comprises the step of including in said first or second aqueous ink said dye comprising at least one member selected from the group consisting of an anionic and a cationic dye and mixtures thereof, and said pigment in said aqueous ink is at least one member selected from the group consisting of carbon black, cyan, magenta, and yellow pigments and mixtures thereof with an average particle size of less than 3.0 microns.

10. A process according to claim 1, wherein the first or second aqueous ink and the first or second clear aqueous liquid includes an anticurl agent comprising glycerine (glycerol) propoxylates, glycerine (glycerol) ethoxylates, glycerine (glycerol) mixed ethoxylates and propoxylates, and alkanediols and alkanetriols with hydroxyl groups at 1 and 3 carbon atom positions.

11. A process according to claim 1, further comprises the steps of applying the first or second clear aqueous liquid using at least one of a single printhead, a partial width array printhead, a full-width array printhead, a roller, a steaming device or a spray applicator or combinations thereof.

12. A process according to claim 1, further comprises the steps of applying the first or second clear aqueous liquid selectively by a thermal ink jet printing method.

13. A process according to claim 1, wherein the steps of applying the first or second aqueous ink is applied on each side of the substrate by a thermal ink jet printing method.

14. A process according to claim 1, wherein steps of applying the first clear aqueous liquid and the second clear aqueous liquid provide complete solid area coverage on respective sides of the substrate to which the first clear aqueous liquid and the second clear aqueous liquid are applied.

15. A process according to claim 1, wherein the process further comprises at any stage before, during or after applying the first or second aqueous ink or applying the first or second clear aqueous liquid.

16. A process according to claim 15, wherein said heating means is at least one member selected from the group consisting of a heated belt, a heated platen or roller, a lamp, a radiant heater, a microwave heater, a hot air dryer and combinations thereof.

* * * * *